US008920057B2

(12) United States Patent
Noguchi

(10) Patent No.: US 8,920,057 B2
(45) Date of Patent: Dec. 30, 2014

(54) MECHANICAL PENCIL

(75) Inventor: Yoshio Noguchi, Saitama (JP)

(73) Assignee: Kotobuki & Co., Ltd., Saitama (JP)

( * ) Notice: Subject to any disclaimer, the term of this patent is extended or adjusted under 35 U.S.C. 154(b) by 445 days.

(21) Appl. No.: 13/509,821

(22) PCT Filed: Nov. 15, 2010

(86) PCT No.: PCT/JP2010/070273

§ 371 (c)(1),
(2), (4) Date: May 15, 2012

(87) PCT Pub. No.: WO2011/062131

PCT Pub. Date: May 26, 2011

(65) Prior Publication Data

US 2012/0230751 A1 Sep. 13, 2012

(30) Foreign Application Priority Data

Nov. 20, 2009 (JP) ..... 2009-264614

(51) Int. Cl.

| | |
|---|---|
| ***B43K 21/22*** | (2006.01) |
| ***B43K 21/02*** | (2006.01) |
| ***B43K 21/16*** | (2006.01) |
| ***B43K 21/24*** | (2006.01) |
| ***B43K 29/02*** | (2006.01) |

(52) U.S. Cl.

CPC ..... *B43K 21/02* (2013.01); *B43K 21/16* (2013.01); *B43K 21/22* (2013.01); *B43K 21/24* (2013.01); *B43K 29/02* (2013.01)

USPC ..... 401/93; 401/92; 401/65

(58) Field of Classification Search

USPC ..... 401/54, 65, 66, 92–94

See application file for complete search history.

(56) References Cited

U.S. PATENT DOCUMENTS

| | | | | |
|---|---|---|---|---|
| 3,850,531 | A * | 11/1974 | Ackermann | 401/65 |
| 7,654,763 | B2 * | 2/2010 | Izawa et al. | 401/93 |

(Continued)

FOREIGN PATENT DOCUMENTS

| | | |
|---|---|---|
| JP | 51-8242 | 1/1976 |
| JP | 59-107286 | 7/1984 |

(Continued)

OTHER PUBLICATIONS

Abstract and English Translation for Japanese Unexamined Patent Application Publication No. JP 11-48680.

(Continued)

*Primary Examiner* — David Walczak
*Assistant Examiner* — Bradley Oliver
(74) *Attorney, Agent, or Firm* — Frost Brown Todd LLC

(57) ABSTRACT

A mechanical pencil comprises a shaft cylinder (1), a lead pipe (3) axially movably inserted into the shaft cylinder (1) and biased in a retract direction, and a chuck body (45) provided within the shaft cylinder (1) in front of the lead pipe (3) for releasably griping a writing lead (S). The lead pipe (3) and the chuck body (45) are separated, the lead pipe (3) is inserted into the shaft cylinder (1) with axial movement thereof being permitted and circumferential rotation thereof being restricted, and the chuck body (45) is positioned within the shaft cylinder (1) in front of the lead pipe (3) so as to be movable in an axial direction and circumferentially rotatable. A lead rotation mechanism (5) is provided between a back part of the chuck body (45) and a front part of the lead pipe (3). When the lead pipe (3) is advanced by a knocking operation or retracted by the release of the knocking operation, when writing pressure is applied to the writing lead (S), and when the writing pressure is released, the lead rotating mechanism (5) rotates the chuck body (45), but does not transmit the rotation force to the lead pipe (3).

15 Claims, 10 Drawing Sheets

(56) References Cited

U.S. PATENT DOCUMENTS

| | | | | |
|---|---|---|---|---|
| 7,802,936 | B1 * | 9/2010 | Izawa et al. | 401/93 |
| 7,806,615 | B1 * | 10/2010 | Izawa et al. | 401/93 |
| 7,815,385 | B2 * | 10/2010 | Izawa et al. | 401/93 |
| 7,850,380 | B2 * | 12/2010 | Izawa et al. | 401/93 |
| 7,850,381 | B2 * | 12/2010 | Izawa et al. | 401/93 |
| 8,328,446 | B2 * | 12/2012 | Izawa et al. | 401/93 |
| 8,337,107 | B2 * | 12/2012 | Ohsawa et al. | 401/93 |
| 2009/0180824 | A1 * | 7/2009 | Izawa et al. | 401/66 |
| 2010/0166486 | A1 * | 7/2010 | Izawa et al. | 401/66 |
| 2010/0254746 | A1 * | 10/2010 | Izawa et al. | 401/65 |
| 2010/0266325 | A1 * | 10/2010 | Izawa et al. | 401/93 |
| 2010/0322695 | A1 * | 12/2010 | Ohsawa et al. | 401/65 |
| 2011/0002728 | A1 * | 1/2011 | Izawa et al. | 401/66 |
| 2014/0079462 | A1 * | 3/2014 | Hosoya et al. | 401/65 |

FOREIGN PATENT DOCUMENTS

| | | |
|---|---|---|
| JP | 11-48680 | 2/1999 |
| JP | 3885315 | 4/1999 |
| JP | 4240417 | 3/2009 |
| WO | WO 2007/142135 | 12/2007 |

OTHER PUBLICATIONS

English Translation for Japenese Patent Gazette No. JP 3885315.
English Translation for Japanese Patent Gazette No. JP 4240417.
English Translation for International Patent Application Publication No. WO 2007/142135.
English Translation of International Preliminary Report on Patentability dated Jun. 12, 2012 for International Patent Application No. PCT/JP2010/070273.

* cited by examiner

MECHANICAL PENCIL

TECHNICAL FIELD

The present invention relates to a mechanical pencil with a lead rotating mechanism.

BACKGROUND ART

A conventional popular mechanical pencil comprises a shaft cylinder having a tip member, a lead pipe inserted into the shaft cylinder and biased in a retract direction, and a chuck body coupled to a tip of the lead pipe for releasably gripping a writing lead. The lead pipe is advanced by a knocking operation so that the writing lead protrudes from the tip member for writing.

Such a conventional mechanical pencil is used for writing in a state where the writing lead protruding from the tip member is gripped by the chuck body so as not to rotate. Thus, when the mechanical pencil is used for writing with the shaft cylinder grasped by a user in a fixed orientation with respect to a sheet of paper, a lead tip of the writing lead is worn down unevenly due to abrasion, resulting in change of thickness and density of written lines. In order to overcome this, the shaft cylinder should be intermittently rotated during writing. Such an operation is troublesome, and inconvenient in terms of usability.

A mechanical pencil which comprises a chuck unit and a lead rotating mechanism for rotating a writing lead together with the chuck unit by retracting the chuck unit via a pressing force of the writing lead on, for instance, a sheet of paper, is also provided (for example, Patent Documents 1 and 2).

In a mechanical pencil disclosed in Patent Document 1, a chuck body rotating means (lead rotating mechanism) is disposed in a shaft cylinder. By retracting a writing lead while a chuck body opened and closed by a chuck ring grips the writing lead, the chuck body rotating means rotates a so-called chuck unit comprising the chuck body and chuck ring. The chuck body rotating means is comprised of a sliding element, a rotor abutting the sliding element, and a cam on an inner wall surface of the shaft cylinder. The sliding element abuts the back end of the chuck ring opening and closing the chuck body; the rotor moving in association with movement of the sliding element abuts the sliding element; the sliding element, chuck body, and rotor are biased forward; and a writing lead tank is secured to a back part of the chuck body (Patent Document 1: paragraph [0005]). When the writing lead is slightly strongly pressed against a sheet of paper, the sliding element, chuck body, and rotor are retracted against the forward bias. When the press of the writing lead against the sheet of paper is released, the sliding element, chuck body, and rotor rotate while advancing by the forward bias. This rotation causes the chuck body to rotate together with the lead tank, which in turn rotates the writing lead gripped by the chuck body.

In a mechanical pencil disclosed in Patent Document 2, a chuck unit is provided within a shaft cylinder so as to be rotatable and movable forward/backward. The mechanical pencil comprises a rotation-driving mechanism (lead rotating mechanism) for rotation-driving a rotor in association with retraction of the chuck unit by writing pressure of a writing lead. The rotation of the rotor is transmitted to the writing lead via the chuck unit. Since the chuck unit is coupled to a tip of a lead case (Patent Document 2: paragraph [0030]), the rotation-driving mechanism is configured to integrally rotate the chuck unit gripping the writing lead and the lead case.

PRIOR ART DOCUMENT

Patent Document

Patent Document 1: Japanese Patent No. 3885315 (claim 1 and FIG. 1)

Patent Document 2: Japanese Patent No. 4240417 (claim 1 and FIG. 1)

SUMMARY OF THE INVENTION

Problems to be Solved by the Invention

Since each of the mechanical pencils disclosed in Patent Documents 1 and 2 comprises the lead rotating mechanism for rotating the chuck unit in association with retraction of the chuck unit due to the writing pressure of the writing lead, it is possible to rotate the writing lead by the writing pressure to reduce its uneven wear. However, since the chuck unit is integrally coupled with the lead tank or lead case (hereinafter referred to as "lead pipe"), the lead pipe also integrally rotates upon rotation of the chuck unit, which may result in increase in rotational resistance of a lead rotating system to cause poor rotation.

In the mechanical pencil disclosed in each of Patent Documents 1 and 2, only when the chuck unit is retracted by the writing pressure or pressing force of the writing lead gripped by the chuck unit, the lead rotating mechanism rotates the chuck unit. Thus, a usual knocking operation upon delivering the writing lead cannot cause the chuck unit to rotate.

The present invention was made in view of the above described circumstances. An object of the present invention is to provide a mechanical pencil which rotates a chuck body by writing pressure or a pressing force of a writing lead gripped by the chuck body, but does not transmit the rotation force to a lead pipe so as to eliminate inconvenience due to rotation of the lead pipe, and which may also rotate the chuck body by a usual knocking operation.

Means for Solving the Problems

A mechanical pencil according to the present invention comprises a shaft cylinder, a lead pipe axially movably inserted into the shaft cylinder and biased in a retract direction, and a chuck body provided within the shaft cylinder in front of the lead pipe for gripping and releasing a writing lead, wherein the lead pipe and the chuck body are separated, the lead pipe is axially movably inserted into the shaft cylinder, and the chuck body is positioned within the shaft cylinder in front of the lead pipe so as to be movable in an axial direction and rotatable about an axis, wherein a lead rotating mechanism is provided between a back part of the chuck body and a front part of the lead pipe, and wherein when the lead pipe is advanced by a knocking operation, when the lead pipe is retracted by the release of the knocking operation, when writing pressure is applied to the writing lead, and when the writing pressure is released, the lead rotating mechanism rotates the chuck body, but does not transmit the rotation force to the lead pipe.

The lead rotating mechanism of the mechanical pencil according to the present invention is positioned together with a receiving member and a chuck joint so as to be movable in the axial direction and circumferentially rotatable, and is configured to rotate the chuck body by the rotation of the chuck joint when the lead pipe is advanced by the knocking operation, when the lead pipe is retracted by the release of the knocking operation, when the writing pressure is applied to the writing lead, and when the writing pressure is released. The receiving member is attached under bias in a retract direction with axial movement permitted and rotation about the axis controlled. The chuck joint is integrally anchored to a back part of a lead chuck of the chuck body.

The lead rotating mechanism of the mechanical pencil according to the present invention comprises a tip cam face on a non-rotating side which is formed at a tip of the receiving member, and an inner cam face on a rotating side which is formed on an inner face of a back part of the chuck joint to be opposed to the tip cam face of the receiving member. When the chuck body is retracted by the writing pressure of the writing lead, and when the lead pipe and receiving member are advanced by the knocking operation, the lead rotating mechanism is configured to rotate the chuck body while the tip cam face of the receiving member mates with the inner cam face of the chuck joint.

The lead rotating mechanism of the mechanical pencil according to the present invention comprises an inner cylinder that is axially movably inserted into the shaft cylinder and biased in the retract direction with its rotation about the axis controlled. The lead rotating mechanism has an inner cam face on the non-rotating side which is formed inside of the inner cylinder, and an outer cam face on the rotating side which is formed outside of the chuck joint to be opposed to the inner cam face of the inner cylinder. When the chuck body is advanced by releasing the writing pressure of the writing lead, and when the lead pipe and the inner cylinder are retracted by the release of the knocking operation, the lead rotating mechanism is configured to rotate the chuck body while the outer cam face of the chuck joint mates with the inner cam face of the inner cylinder.

In the mechanical pencil according to the present invention, in a normal condition in which the chuck body grips the writing lead without the writing pressure applied, respective apexes of the inner cam face of the chuck joint and the tip cam face of the receiving member are circumferentially position-shifted.

In the mechanical pencil according to the present invention, the outer cam face of the chuck joint and the inner cam face of the inner cylinder are configured such that when the writing pressure is applied to the writing lead, and upon the knocking operation, the chuck joint rotates to a position where apexes of the cam faces are circumferentially position-shifted so as to separately hold the outer cam face of the chuck joint and the inner cam face of the inner cylinder.

In the mechanical pencil according to the present invention, the back end of the chuck joint has resilient pieces integrally provided at a back part thereof.

Effects of the Invention

According to the mechanical pencil of the present invention, the lead pipe and the chuck body are separated, and the lead rotating mechanism between the lead pipe and the chuck body rotates the chuck body without transmitting the rotation force to the lead pipe system when the lead pipe is advanced by the knocking operation, when the lead pipe is retracted by the release of the knocking operation, when the writing pressure is applied to the writing lead, and when the writing pressure is released. This brings about an effect that inconvenience due to integral rotation of the chuck body and lead pipe can be eliminated, and a usual knocking operation may rotate the chuck body.

According to the mechanical pencil of the present invention, the receiving member is anchored to the front part of the lead pipe, and is axially movably inserted into the shaft cylinder with its circumferential rotation being restricted. This brings about an effect that the chuck body may be smoothly rotated during the application and release of the writing pressure of the writing lead or during the knocking operation and the release of the knocking operation.

The mechanical pencil of the present invention brings about an effect that when the chuck body is retracted by the writing pressure of the writing lead, and when the lead pipe and receiving member are integrally advanced by the knocking operation, a cam action provided by mating of the tip cam face of the receiving member and the inner cam face of the chuck joint may smoothly rotate the chuck body.

The mechanical pencil of the present invention brings about an effect that when the writing pressure of the writing lead is released and when the lead pipe and the inner cylinder are retracted by the release of the knocking operation, the inner cam face of the inner cylinder mates with the outer cam face of the chuck joint, and a cam action may smoothly rotate the chuck body.

According to the mechanical pencil of the present invention, while in a normal condition in which the chuck body grips the writing lead without the writing pressure applied, respective apexes of the inner cam face of the chuck joint and the tip cam face of the receiving member are circumferentially position-shifted. This brings about an effect that the above described cam action associated with movement of the chuck body when the writing pressure is applied to the writing lead and during the knocking operation may be smoothly carried out.

According to the mechanical pencil of the present invention, when the writing pressure is applied to the writing lead, and upon the knocking operation, the chuck body rotates to a position where respective apexes of the outer cam face of the chuck joint and the inner cam face of the inner cylinder are circumferentially position-shifted such that the outer cam face and the inner cam face are kept spaced apart from each other. This brings about an effect that when the chuck body is advanced upon release of the writing pressure of the writing lead and upon release of the knocking operation, the chuck unit may be smoothly rotated while mating the outer cam face with the inner cam face.

According to the mechanical pencil of the present invention, the resilient pieces are integrally formed on the back end of the chuck joint. This brings about an effect that a spring member distinct from the chuck joint may be eliminated.

EMBODIMENTS FOR CARRYING OUT THE INVENTION

Embodiment

Figure 1:
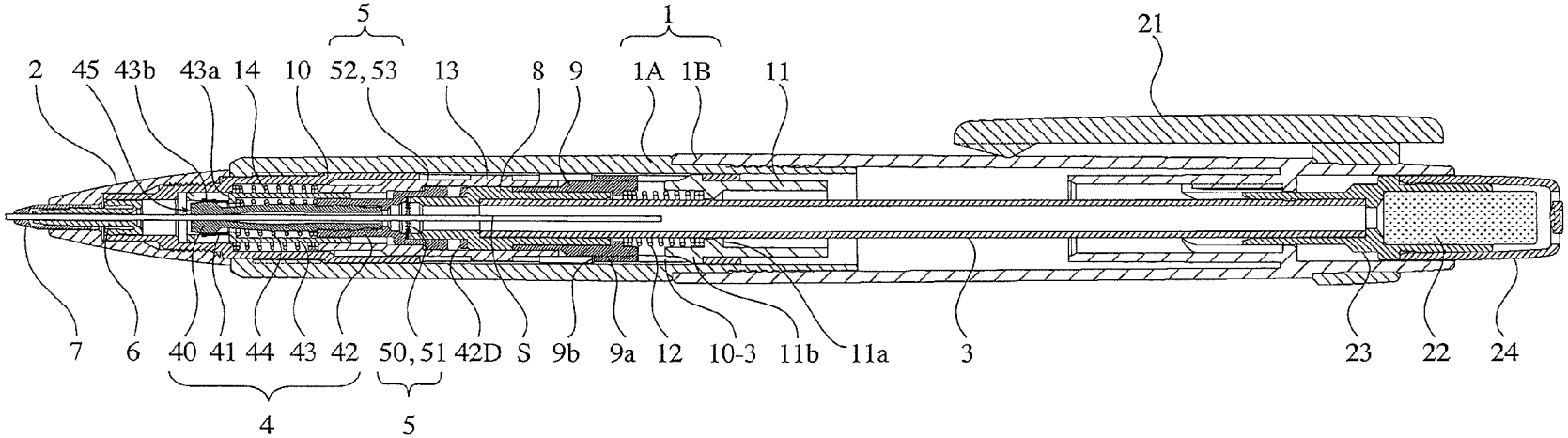
FIG. 1 is a cross-sectional view showing a mechanical pencil according to an embodiment of the present invention.
Figure 2A:
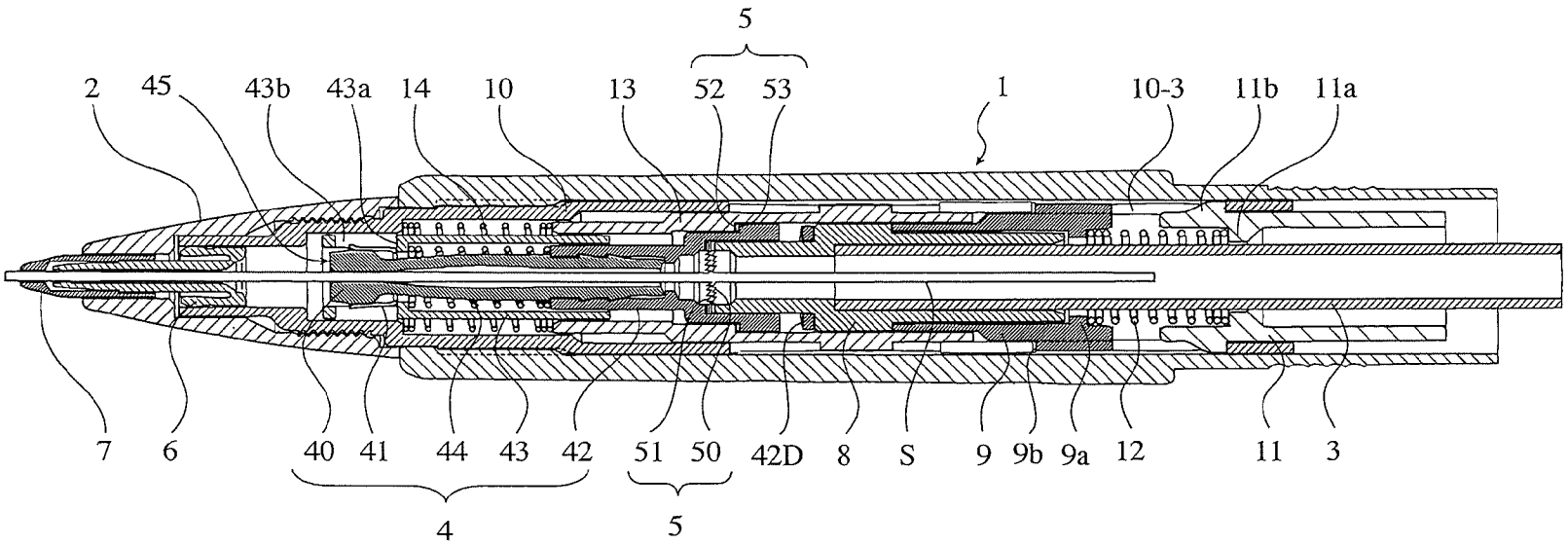
FIGS. 2A and 2B are enlarged cross-sectional views which illustrate a main part of the embodiment shown in FIG. 1 and explain the operation of the embodiment.
Figure 2B:
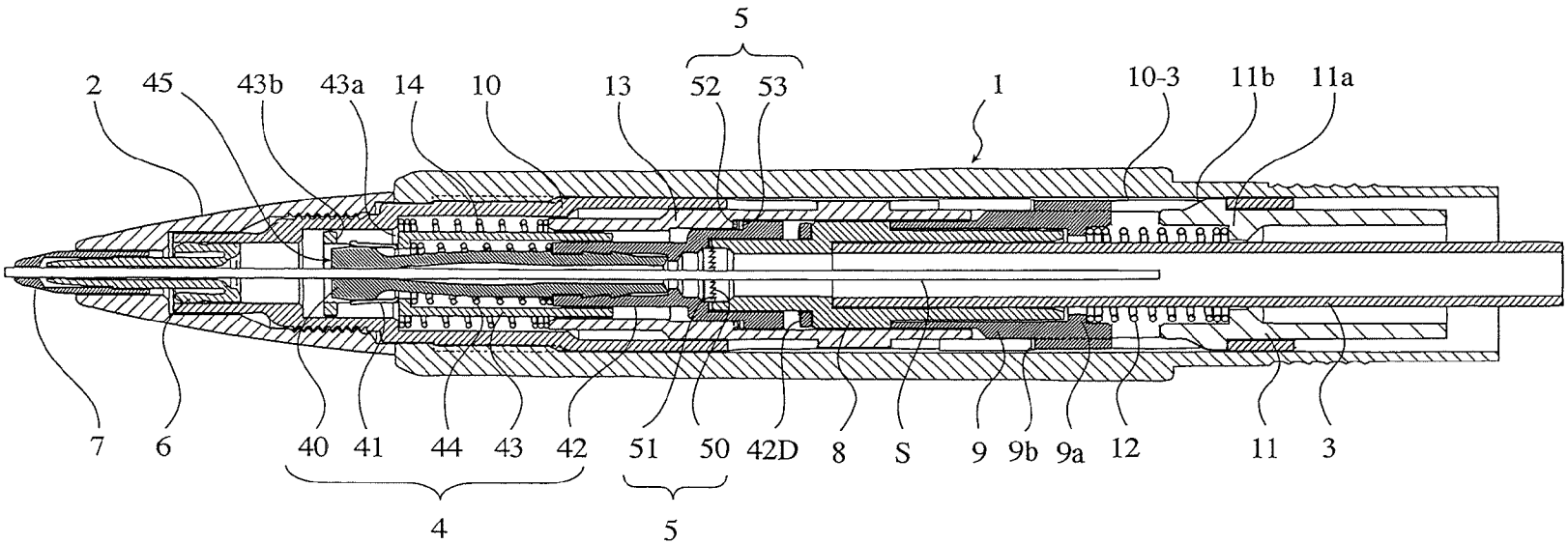
Figure 3:
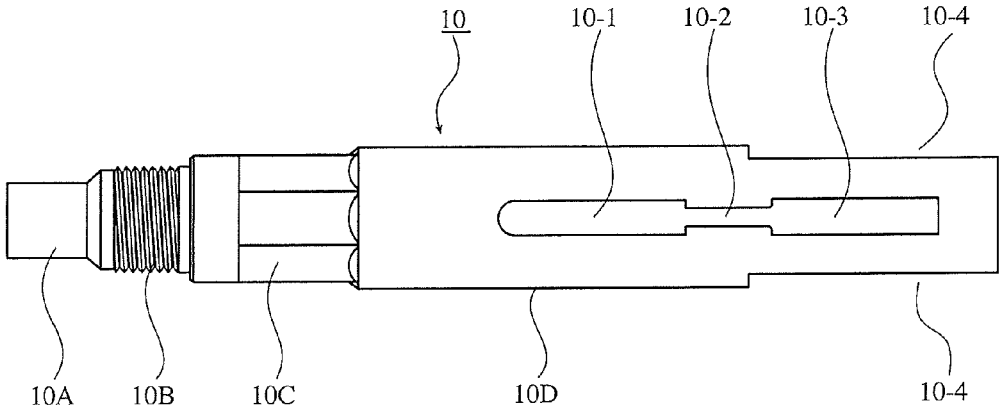
FIG. 3 is a plan view showing an inner shaft of the embodiment shown in FIG. 1.
Figure 4:
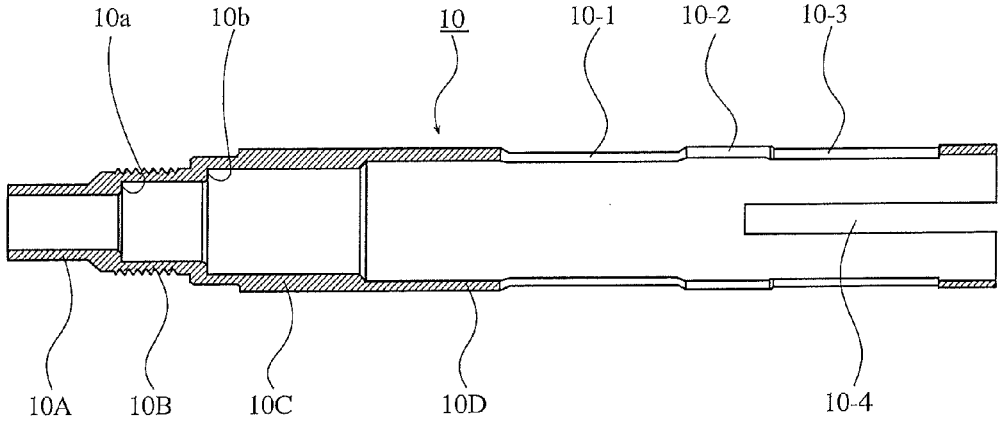
FIG. 4 is an axial cross-sectional view of the inner shaft shown in FIG. 3.
Figure 5:
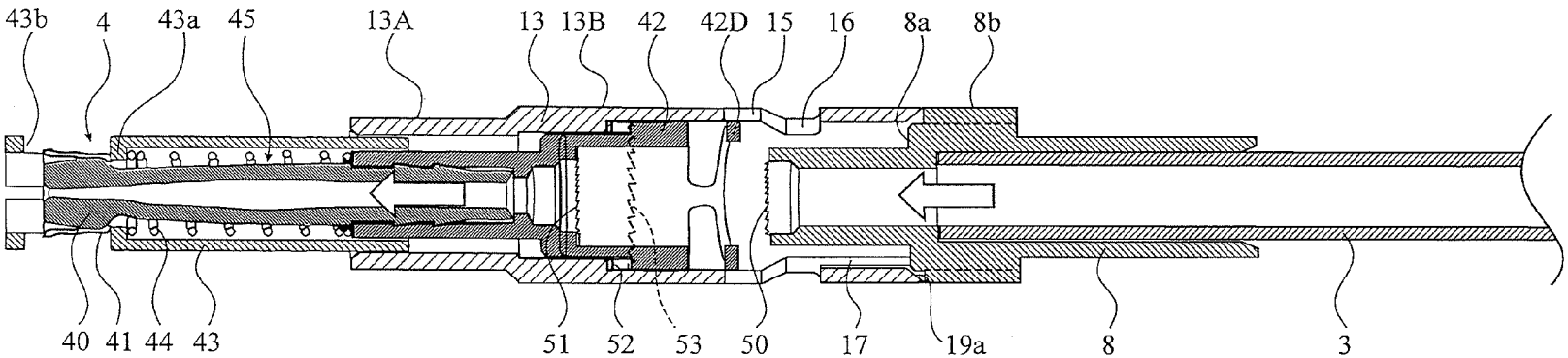
FIG. 5 is a cross-sectional view showing an assembled structure of a mechanical unit, inner cylinder, and receiving member.
Figure 6:
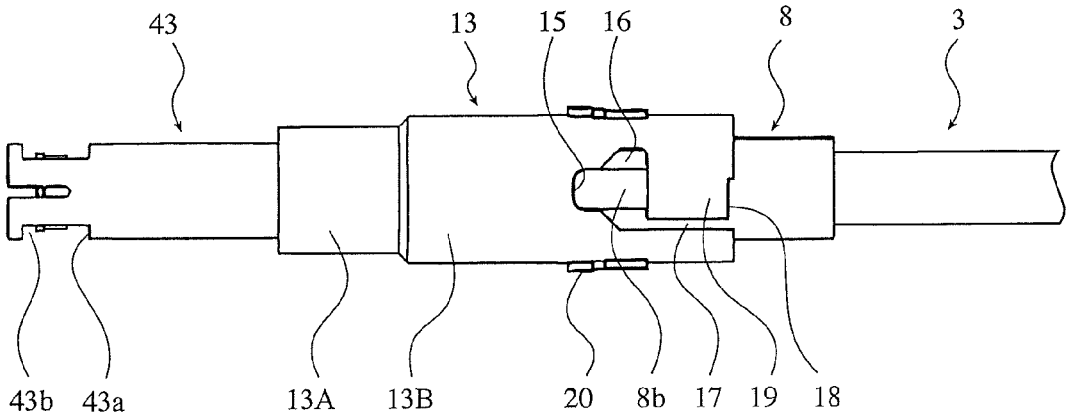
FIG. 6 is a plan view of the assembled structure shown in FIG. 5.
Figure 7:
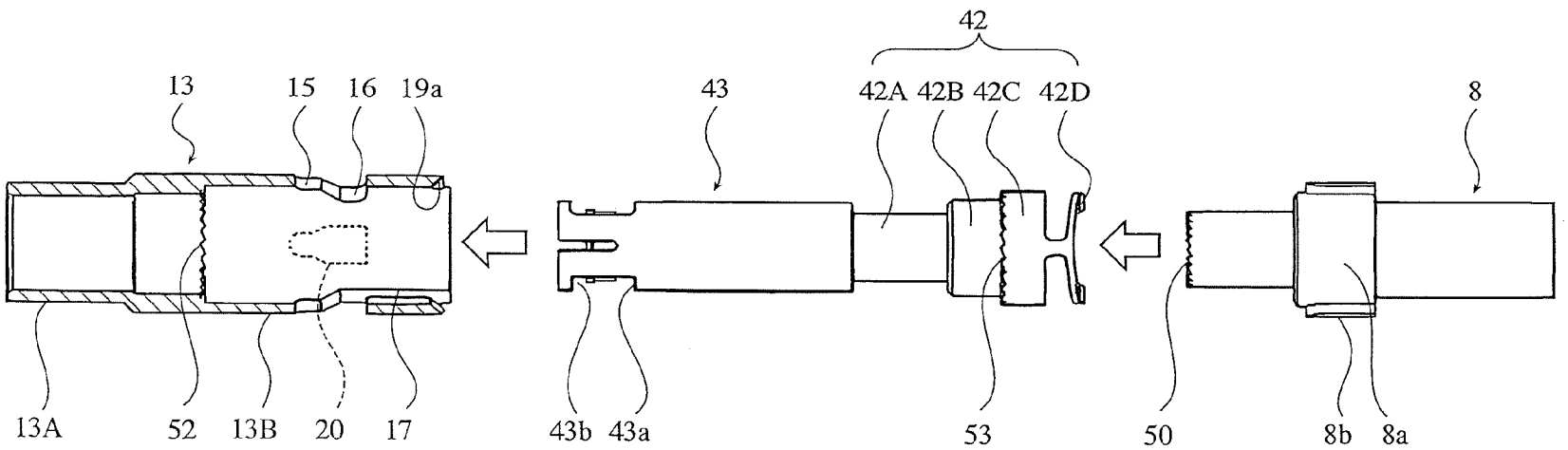
FIG. 7 is an exploded view of the structure shown in FIG. 6.
Figure 8:
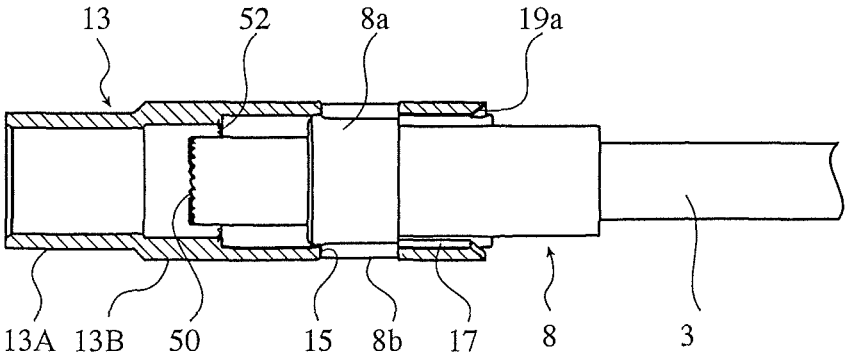
FIG. 8 is a cross-sectional view of the inner cylinder to which the receiving member is attached.
Figure 9A:
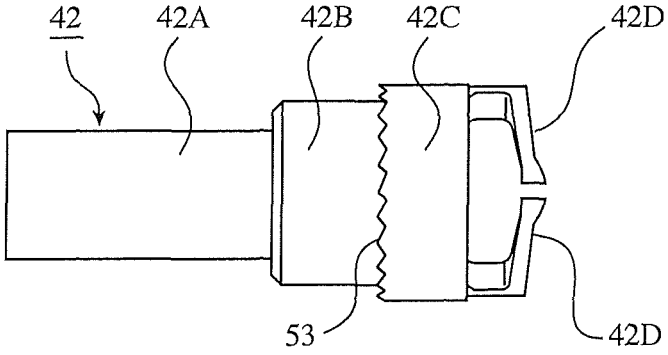
FIG. 9A is a plan view of a chuck joint.
Figure 9B:
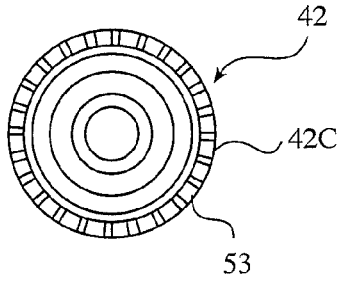
FIG. 9B is a left side view of the chuck joint shown in FIG. 9A.
Figure 9C:
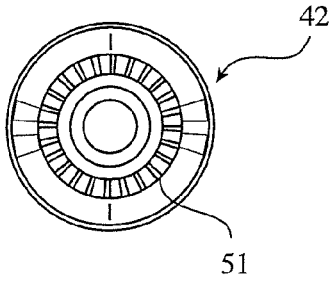
FIG. 9C is a right side view of the chuck joint shown in FIG. 9A.
Figure 10:
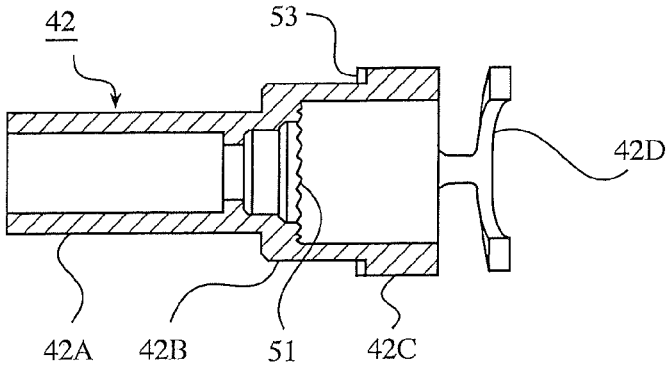
FIG. 10 is an axial cross-sectional view of the chuck joint shown in FIG. 9A.

FIG. 1 is a cross-sectional view showing a mechanical pencil according to an embodiment of the present invention; FIGS. 2A and 2B are enlarged cross-sectional views which illustrate a main part of the embodiment shown in FIG. 1 and explain the operation of the embodiment; FIG. 3 is a plan view showing an inner shaft of the embodiment shown in FIG. 1; FIG. 4 is an axial cross-sectional view of the inner shaft shown in FIG. 3; FIG. 5 is a cross-sectional view showing an assembled structure of a mechanical unit, inner cylinder, and receiving member; FIG. 6 is a plan view of the assembled structure shown in FIG. 5; FIG. 7 is an exploded view of the structure shown in FIG. 6; FIG. 8 is a cross-sectional view of the inner cylinder to which the receiving member is attached; FIG. 9A is a plan view of a chuck joint; FIG. 9B is a left side view of the chuck joint shown in FIG. 9A; FIG. 9C is a right side view of the chuck joint shown in FIG. 9A; and FIG. 10 is an axial cross-sectional view of the chuck joint shown in FIG. 9A.

The mechanical pencil according to the embodiment comprises a shaft cylinder 1, a tip member 2 mounted to a tip of the shaft cylinder 1, a lead pipe 3 inserted into the shaft cylinder 1 for containing a writing lead, a mechanical unit 4 mainly including a chuck body 45 which is separated from and positioned in front of the lead pipe 3 for releasably gripping the writing lead S, the chuck body 45 comprising a lead chuck 40 and a chuck joint 42, and a lead rotating mechanism 5. When the lead pipe 3 is advanced by a knocking operation or retracted upon release of the knocking operation, when writing pressure is applied to the writing lead S, and when the writing pressure is released, the lead rotating mechanism 5 is adapted to rotate the chuck body 50 and, therefore, the wiring lead S gripped by the chuck body 45. The detailed structure of the lead rotating mechanism 5 will be described below.

The shaft cylinder 1 is divided into a front shaft 1A and a back shaft 1B. A back part of the front shaft 1A and a front part of the back shaft 1B are detachably coupled by means of, for example, screw-thread engagement. A stepped cylindrical inner shaft 10 is detachably inserted into a front part of the front shaft 1A. As shown in FIGS. 3 and 4, the inner shaft 10 comprises a first cylindrical portion 10A that is a smallest-diameter tip portion, a second cylindrical portion 10B continuous with the back end of the first cylindrical portion 10A, a third cylindrical portion 10C continuous with the back end of the second cylindrical portion 10B, and a fourth cylindrical portion 10D continuous with the back end of the third cylindrical portion 10C. The first cylindrical portion 10A has the smallest diameter, and diameters of the second cylindrical portion 10B, third cylindrical portion 10C, and fourth cylindrical portion 10D are sequentially enlarged.

In the inner shaft 10, an outer periphery of the second cylindrical portion 10B is provided with an external thread for threadably engaging the tip member 2. An outer periphery of the third cylindrical portion 10C has a polygonal cross section. By fitting the third cylindrical portion 10C into a tip opening of the shaft cylinder 1 (front shaft 1A) with an inner periphery also having a polygonal cross section, the inner shaft 10 is attached non-rotatably relative to the shaft cylinder 1.

As shown in FIG. 4 in detail, the inner shaft 10 has a front inner stepped surface 10*a* against which a tip of the mechanical unit 4 disengageably abutted, and an intermediate inner stepped surface 10*b* against which the front end of a return spring 14 described below is abutted. Further, in the inner shaft 10, the fourth cylindrical portion 10D is sequentially provided with front slits 10-1, narrow intermediate slits 10-2 continuous with the backs of the front slits 10-1, and wide back slits 10-3 continuous with the backs of the intermediate slits 10-2. Back end open slits 10-4 with notched open back ends are axially formed at a back part of the fourth cylindrical portion 10D.

In an anti-rotation condition in which the third cylindrical portion 10C is fitted into the tip opening of the front shaft 1A and engaged with the front shaft 1A, whereby the inner shaft 10 is prevented from being rotated relative to the front shaft 1A, the first cylindrical portion 10A and second cylindrical portion 10B of the inner shaft 10 protrude forward from the front shaft 1A, and the tip member 2 is threadably engaged with the external thread of the second cylindrical portion 10B. A back part of a slider 6 is slidably inserted into the first cylindrical portion 10A. A front part of the slider 6 is freely fit into a central hole of the tip member 2. A distal tip 7 is slidably fitted into a space between an inner periphery of the central hole of the tip member 2 and an outer periphery of the front part of the slider 6.

An inner cylinder 13 composing a cam cylinder on a stationary side is incorporated in the inner shaft 10 so that the inner cylinder 13 is axially movable but restricted from being rotated relative to the inner shaft 10.

As shown in FIGS. 5-8, the inner cylinder 13 comprises a small-diameter cylinder portion 13A at its front part and a large-diameter cylinder portion 13B at its back part. The large-diameter cylinder portion 13B has engagement holes 15 for engaging with engagement projections 8*b* of a receiving member 8 described below, wide openings 16 formed continuously with the back ends of the engagement holes 15, slits 17 (FIG. 6) opening to the back end of the large-diameter cylinder portion 13B, each of which is continuous with one side of the respective wide opening 16, and back end cutouts 18 formed on the back end of the large-diameter cylinder portion 13B at positions generally aligned with the engagement holes 15 in an axial direction of the inner cylinder 13. Cutout pieces 19, each surrounded by the wide opening 16, slit 17, and back end cutout 18, are provided. A chamfered taper surface 19*a* is formed at the back end face of each cutout piece 19.

In this inner cylinder 13, anti-rotation projections 20 (FIGS. 6 and 7) are integrally formed on the exterior of the large-diameter cylinder portion 13B in a radially protruding manner. By slidably fitting the projections 20 in the front slits 10-1 of the inner shaft 10, the inner cylinder 13 is axially movable but is non-rotatable relative to the inner shaft 10.

The inner cylinder 13 mounted to the inner shaft 10 in this way is biased in a retract direction by a return spring 14, as shown in FIGS. 1 and 2. The receiving member 8 which is fixedly press-fitted over the front part of the lead pipe 3 is axially movably inserted into the inner cylinder 13. As shown in FIG. 5, the receiving member 8 comprises a stepped cylinder body which has a large-diameter annular wall 8*a* integrally formed in the proximity of its axially intermediate part and engagement projections 8*b* integrally formed on an outer diameter surface of the large-diameter annular wall 8*a*. The engagement projections 8*b* engage with the engagement holes 15 of the inner cylinder 13. Therefore, the receiving member 8 and inner cylinder 13 are integrally combined. The mechanical unit 4 is placed in front of the receiving member 8 configured in this way.

The mechanical unit 4 comprises a unit structure. The unit structure comprises a lead chuck 40, a chuck ring 41 fitted over a tip chuck part of the lead chuck 40, a chuck joint 42 fixedly mounted around a back part of the lead chuck 40, a sleeve 43 into which the lead chuck 40 and a front part of the chuck joint 42 are axially movably inserted, and a chuck spring 44 interposed between an inward facing flange 43*a* integrally formed at a front part of the sleeve 43 and the front end of the chuck joint 42. Incidentally, the sleeve 43 has window holes 43*b* provided in a front part thereof extending in front of the inward facing flange 43*a*. The chuck ring 41 is arranged in the window holes-formed front part of the sleeve 43 such that the back end of the chuck ring 41 is separatably abutted on the front end face of the inward facing flange 43*a*.

As shown especially in FIGS. 9 and 10, the chuck joint 42 comprises a small-diameter cylindrical portion 42A into which the back part of the lead chuck 40 is fixedly press-fitted, an intermediate cylindrical portion 42B continuous with the back end of the small-diameter cylindrical portion 42A and having a diameter larger than the small-diameter cylindrical portion 42A, a large-diameter cylindrical portion 42C continuous with the back end of the intermediate cylindrical portion 42B and having an outer diameter larger than the intermediate cylindrical portion 42B and the same inner diameter as the intermediate cylindrical portion 42B, and resilient pieces 42D continuous with the back end of the large-diameter cylindrical portion 42C. In the chuck joint 42 configured in this way, the back part of the lead chuck 40 is fixedly press-fitted into the front small-diameter cylindrical portion 42A, and the back part of the chuck joint 42 (large-diameter cylindrical portion 42C and intermediate cylindrical portion 42B) is rotatably and freely fitted around the receiving member 8.

A spacer 9 mounted on the back side of the receiving member 8, a stopper 11 behind the spacer 9, and a cushion spring 12 between the spacer 9 and stopper 11 are mounted around the exterior of the lead pipe 3.

The spacer 9 comprises a stepped cylinder body, and has an inner annular projection 9*a* integrally formed on its back inner periphery and anti-rotation projections 9*b* radially protruding from its back outer surface. The anti-rotation projections 9*b* of the spacer 9 are slidably fitted into the back slits 10-3 of the inner shaft 10 in such a manner that the spacer 9 is allowed to be axially movable. The spacer 9 is biased in the advance direction by resilience of the cushion spring 12 such that the inner annular projection 9*a* is abutted on a back part of the receiving member 8.

The stopper 11 comprises a cylinder body, and has an inner annular projection 11*a* formed on its front inner periphery and anti-rotation projections 11*b* radially protruding from the front outer surface. The anti-rotation projections 11*b* are fitted into the back slits 10-3 of the inner shaft 10 behind the anti-rotation projections 9*b* of the spacer 9. The resilience of the cushion spring 12 interposed between the spacer 9 and the stopper 11 always biases the stopper 11 backward such that the anti-rotation projections 11*b* are pressed against the back end walls of the back slits 10-3. This allows the stopper 11 to be always held at a fixed position.

The lead rotating mechanism 5 comprises a first cooperation means on the chuck joint 42 and the receiving member 8 and a second cooperation means on the chuck joint 42 and the inner cylinder 13.

As clearly shown in FIG. 5, the first cooperation means of the lead rotating mechanism 5 comprises a tip cam face 50 on a non-rotating side which is formed at a tip of the receiving member 8, and an inner cam face 51 on a rotating side which is formed on an inner step of the intermediate cylindrical portion 42B of the chuck joint 42 so as to be opposed to the tip cam face 50 of the receiving member 8 in the axial direction. When the chuck body 45 is retracted by the writing pressure of the writing lead S, and when the lead pipe 3 and receiving member 8 are integrally advanced by the knocking operation, the inner cam face 51 of the chuck joint 42 is operatively mated with the tip cam face 50 of the receiving member 8, whereby the whole chuck body 45 including the chuck joint 42 is rotated.

The second cooperation means of the lead rotating mechanism 5 comprises an inner cam face 52 (FIGS. 5 and 10) on the non-rotating side which is formed on an inner step of the inner cylinder 13, and an outer cam face 53 (FIGS. 5, 7, 9, and 10) on the rotating side which is formed on the front end wall surface of the large-diameter cylindrical portion 42C of the chuck joint 42 to so as to be opposed to the inner cam face 52 of the inner cylinder 13. When the chuck body 45 is advanced by releasing the writing pressure of the writing lead, the outer cam face 53 of the chuck joint 42 is operatively mated with the inner cam face 52 of the inner cylinder 13, whereby the chuck body 45 is rotated.

The cam faces 50, 51, 52, 53 each comprise cam noses having apexes. The chuck body 45 is adapted to be rotated in such a manner that the apexes of the inner cam face 51 of the chuck joint 42 and the apexes of the outer cam face 53 of the chuck joint 42 are circumferentially shifted relative to those of the tip cam face 50 of the receiving member 8 and those of the inner cam face 52 of the inner cylinder 13, respectively. Incidentally, the position shift angle of the apexes is preferably about 3.5 degrees but is not limited to this.

Figure 11A:
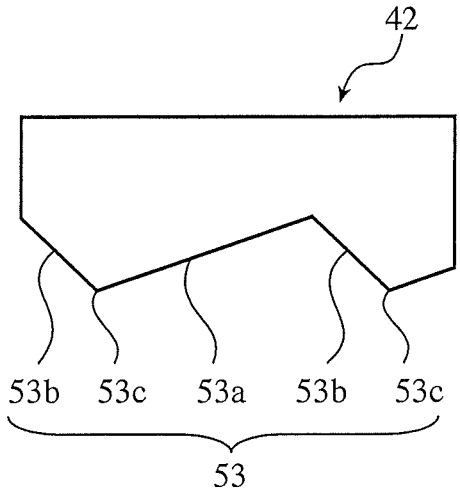
FIG. 11A is a developed view partially showing an outer cam face.
Figure 11B:
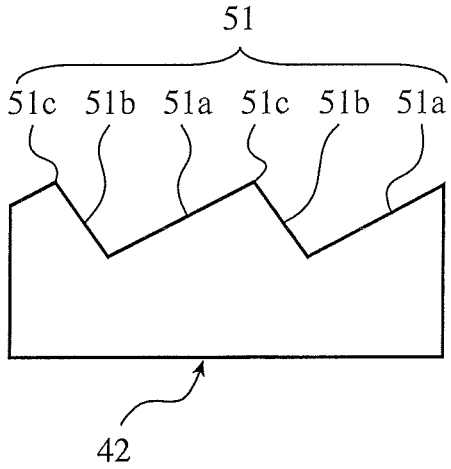
FIG. 11B is a developed view partially showing an inner cam face.

More specifically, FIG. 11A is a developed view partially showing a formation site of the outer cam face 53 of the chuck joint 42, and FIG. 11B is a developed view partially showing a formation site of the inner cam face 51 of the chuck joint 42. As shown in FIG. 11A, the outer cam face 53 of the chuck joint 42 comprises mild slope cam face portions 53*a* and steep slope cam face portions 53*b* which are alternately and continuously formed in a circumferential direction of the chuck joint 42. Similarly, the inner cam face 51 of the chuck joint 42 shown in FIG. 11B comprises mild slope cam face portions 51*a* and steep slope cam face portions 51*b* which are alternately and continuously formed in the circumferential direction of the chuck joint 42.

The inner cam face 52 of the inner cylinder 13 which is opposed to the outer cam face 53 of the chuck joint 42, and the tip cam face 50 of the receiving member 8 which is opposed to the inner cam face 51 of the chuck joint 42 also comprise mild slope cam face portions and steep slope cam face portions in the same manner as the outer cam face 53 and inner cam face 51 of the chuck joint 42.

The apexes 53*c* of the outer cam face 53 of the chuck joint 42 and the apexes (not shown) of the inner cam face 52 of the inner cylinder 13 are position-shifted in the circumferential direction. Similarly, the apexes 51*c* of the inner cam face 51 of the chuck joint 42 and the apexes (not shown) of the tip cam face 50 of the receiving member 8 are position-shifted in the circumferential direction.

In the lead rotating mechanism 5 configured in this way, in a normal state where the writing lead S gripped by the chuck body 45 is not subjected to the writing pressure, or in a state where the knocking operation is not performed, the apexes of the cam face 51 are circumferentially shifted relative to the apexes of the cam face 50 as described above, and the cam face 51 of the chuck joint 42 is kept spaced apart from the cam face 50 of the receiving member 8. In this state, the apexes of the cam face 53 are circumferentially shifted relative to the apexes of the cam face 52 as described above, and the cam face 53 of the chuck joint 42 are mated with the cam face 52 of the inner cylinder 13. To the contrary, when the writing lead S gripped by the chuck body 45 is subjected to the writing pressure, or when the knocking operation is performed, the cam face 51 of the chuck joint 42 is brought to a state where it is mated with the cam face 50 of the receiving member 8. At this time, the cam face 53 of the chuck joint 42 is brought to a state where it is spaced apart from the cam face 52 of the inner cylinder 13 with the apexes thereof being still shifted relative to the apexes of the cam face 52.

A clip 21 is attached to the outside of the back part of the shaft cylinder 1. An eraser holder 23 with an eraser 22 fitted therein is fitted to the back end of the lead pipe 3. An eraser cover 24 which also functions as a knocking member is fitted to the eraser holder 23.

The assembling of the mechanical pencil according to the embodiment will be discussed hereinafter. First, the chuck ring 41 is inserted into the sleeve 43 through any one of the window holes 43*b* of the sleeve 43 and the lead chuck 40 is then inserted from the tip opening of the sleeve 43 into the chuck ring 41. Then, the chuck spring 44 is inserted into the sleeve 43 from the back end opening of the sleeve 43 and fitted over the lead chuck 40. Thereafter, the small-diameter cylindrical portion 42A of the chuck joint 42 is fitted over the back part of the lead chuck 40 while being inserted into the sleeve 43 from the back end opening of the sleeve 43, whereby the mechanical unit is assembled.

The front part of the lead pipe 3 is press-fitted into the back part of the receiving member 8. The press-fitting operation may be performed in a later step. The mechanical unit 4 is then inserted into the inner cylinder 13 from the back end opening of the inner cylinder 13 and, thereafter, the side of the receiving member 8 which is formed with the tip cam face 50 is inserted into the back end opening of the chuck joint 42 while being inserted into the inner cylinder 13 from the back end opening of the inner cylinder 13, and the engagement projections 8*b* on the outer surface of the receiving member 8 are operatively engaged in the engagement holes 15 of the inner cylinder 13. In this case, when pushing of the receiving member 8 into the back end opening of the chuck joint 42 is performed while allowing the front ends of the engagement projections 8*b* of the receiving member 8 to be abutted against the chamfered taper surfaces 19*a* of the cutout pieces 19 of the inner cylinder 13, the engagement projections 8*b* are passed by the cutout pieces 19 while expanding the cutout pieces 19 outward in a radial direction of the inner cylinder 13, and then operatively engaged in the engagement holes 15 of the inner cylinder 13.

Thus, the mechanical unit 4 and receiving member 8 are unitized by the inner cylinder 13. In this unitization condition, the mechanical unit 4 is maintained in a state where it is axially movable and circumferentially rotatable with respect to the inner cylinder 13, and the receiving member 8 is maintained in a state where it fixed to the inner cylinder 13 by the engagement between the engagement projections 8*b* of the receiving member 8 and the engagement holes 15 of the inner cylinder 13. In this way, a unit which comprises the mechanical unit 4, the receiving member 8, and the inner cylinder 13 is assembled. The unit will be hereinafter referred to as a unit body.

After the return spring 14 is inserted into the inner shaft 10 from the back end opening of the inner shaft 10, the unit body is inserted into the inner shaft 10 from the back end opening of the inner shaft 10 with the sleeve 43 facing the inner shaft 10. Since the back end open slits 10-4 are formed in the back part of the inner shaft 10, pushing of the unit body into the inner shaft 10 from the back end opening of the inner shaft 10 causes the back part of the inner shaft 10 to be expanded outwardly in the radial direction thanks to the presence of the back end open slits 10-4, to thereby allow the anti-rotation projections 20 of the inner cylinder 13 to be slidably fitted into the front slits 10-1 of the inner shaft 10. The spacer 9 is inserted into the back part of the inner cylinder 13 until the anti-rotation projections 9*b* of the spacer 9 reach and the anti-rotation projections 9*b* of the spacer 9 are operatively engaged in the back slits 10-3 of the inner shaft 10.

After the cushion spring 12 is mounted around the lead pipe 3, the stopper 11 is fitted over the lead pipe 3, and the anti-rotation projections lib of the stopper 11 are fitted into the back slits 10-3 of the inner shaft 10, such that the anti-rotation projections lib are operatively engaged with the back end walls of the back slits 10-3.

Then, the inner shaft 10 is inserted into the front shaft 1A from the back end opening of the front shaft 1A to cause the front part of the inner shaft 10 to be protruded forward from the tip opening of the front shaft 1A. The slider 6 with the distal tip 7 is inserted into the tip hole of the inner shaft 10. Thereafter, the tip member 2 is threadably fixed to the external thread formed on the front outer periphery of the inner shaft 10. Then, the back shaft 1B provided with the clip 21 is threadably fixed to the back part of the front shaft 1A, the eraser holder 23 having the eraser 22 thereby is inserted into the back part of the back shaft 1B so as to be fitted over the back part of the lead pipe 3, and the eraser cover 24 is then fitted over the eraser holder 23, thereby completing the assembling of the mechanical pencil.

The operation of the mechanical pencil will be hereinafter discussed. In the normal condition in which the lead chuck 40 of the chuck body 45 grips the writing lead S and the writing pressure is not applied to the writing lead S, the outer cam face 53 of the chuck joint 42 and the inner cam face 52 of the inner cylinder 13 are kept in the state where they are mated with each other. The inner cam face 51 of the chuck joint 42 is kept spaced apart from the tip cam face 50 of the receiving member 8 with the apexes of the cam face 51 being circumferentially position-shifted relative to those of the cam face 50.

In this condition, when the writing pressure is applied to the writing lead S gripped by the lead chuck 40, the chuck body 45 is retracted against the action of the cushion spring 12, to thereby cause the inner cam face 51 of the chuck joint 42 to be abutted against the tip cam face 50 of the receiving member 8. Incidentally, as described above, while the receiving member 8 having the cam face 50 is restricted from being circumferentially rotated relative to the inner sleeve 13, the chuck joint 42 having the cam face 51 is adapted to be circumferentially rotatable relative to the inner sleeve 13. The retraction of the chuck body 45 causes the cam face 51 of the chuck joint 42 to be slid on the cam face 50 of the receiving member 8, whereby the chuck joint 42 is rotated and, when the cam face 51 of the chuck joint 42 is finally mated with the cam face 50 of the receiving member 8, the rotation of the chuck joint 42 is stopped. By such a rotation of the chuck joint 42, the chuck body 45 and the writing lead S gripped by the chuck body 45 are also rotated. Synchronously with the retraction of the chuck body 45, the cam face 53 of the chuck joint 42 is moved apart from the cam face 52 of the inner sleeve 13. By the rotation of the chuck body 45, the cam face 53 of the chuck joint 42 is kept in a state where the apexes of the cam noses thereof are slightly shifted relative to those of the cam noses of the cam face 52 of the inner sleeve 13.

When the writing lead S is released from the writing pressure, the chuck body is advanced by the action of the cushion spring 12, whereby the cam face 53 of the chuck joint 42 is abutted against the cam face 52 of the inner sleeve 13. The advancing movement of the chuck body 45 causes the cam face 53 of the chuck joint 42 to be slid on the cam face 52 of the inner sleeve 13, whereby the chuck joint 42 is rotated and, when the cam face 53 of the chuck joint 42 is finally mated with the cam face 52 of the inner sleeve 13, the rotation of the chuck joint 42 is stopped. By such a rotation of the chuck joint 42, the chuck body 45 and the writing lead S gripped by the chuck body 45 are also rotated. Synchronously with the advancing movement of the chuck body 45, the cam face 51 of the chuck joint 42 is moved apart from the cam face 50 of the receiving member 8. By the rotation of the chuck body 45, the cam face 51 of the chuck joint 42 is kept in a state where the apexes of the cam noses thereof are slightly shifted relative to those of the cam noses of the cam face 50 of the receiving member 8.

In the state where the writing lead S gripped by the chuck body 45 is not subjected to the writing pressure, when the eraser cover 24 provided at the back end portion of the lead pipe 3 is knocked, the receiving member 8 and the inner sleeve 13 are advanced together with the lead pipe 3 and the cam face 50 of the receiving member 8 is pressingly abutted against the cam face 51 of the chuck joint 42. At this time, the chuck joint 42 itself is scarcely advanced owing to the resilient deformation of the resilient piece 42D and the action of the chuck spring 44. The advancing movement of the receiving member 8 causes the cam face 51 of the receiving member 8 to be slid on the cam face 50 of the receiving member 8, whereby the chuck joint 42 is rotated. Then, the rotation of the chuck joint 42 is stopped at the position where the cam face 51 of the chuck joint 42 is mated with the cam face 50 of the receiving member 8. The chuck joint 42 is rotated in this way, whereby the chuck body 45 and the writing lead S gripped by the chuck body 45 are also rotated. Moreover, since the inner sleeve 13 is advance while the chuck joint 42 is scarcely advanced as described above, the cam face 53 of the chuck joint 42 is moved apart from the cam face 52 of the inner sleeve 13 and kept in the state where the cam noses of the cam face 53 are slightly shifted relative to those of the cam face 52 due to the rotation of the chuck body 45. When the receiving member 8 is further advanced, the chuck joint 42 is pressed by the receiving member 8 to be advanced against the action of the chuck spring 44, and the lead chuck 40 and the chuck ring 41 are also advanced. Then, the chuck ring 41 is abutted against a step portion formed on a front inner surface of the sleeve 43 to stop and the lead chuck 40 is disengaged from the chuck ring 41 and operatively projects forward from the tip end of the sleeve 43, whereby the writing lead S is advanced while being released from the lead chuck 40.

Next, when the mechanical pencil is released from the knocking operation, the chuck body 45 is returned to the initial position by the action of the chuck spring 44. Thereby, the front end portion of the lead chuck 40 is retracted into the sleeve 43, disengageably fitted into the chuck ring 41, and again grips the writing lead S. Moreover, the inner sleeve 13, the receiving member 8, and lead pipe 3 are moved backward by the action of the return spring 14 and the cam face 52 of the inner sleeve 13 is abutted against the cam face 53 of the chuck joint 42, the backward movement of which is already stopped. When the inner sleeve 13 is further moved backward, the cam face 53 of the chuck joint 42 is slid on the cam face 52 of the inner sleeve 13 to thereby rotate the chuck joint 42. Then, the rotation of the chuck joint 42 is stopped at the position where the cam face 53 of the chuck joint 42 is mated with the cam face 52 of the inner sleeve 13 and the backward movement of the inner sleeve 13, receiving member 8, and lead pipe 3 is stopped. The chuck joint 42 is rotated in this way, whereby the chuck body 45 and the writing lead S gripped by the chuck body 45 are also rotated.

In the embodiment described above, the lead chuck 40 and chuck joint 42 may be integrally formed. The sleeve 43 may not be rotated as long as it is formed from a material with small slide-contact resistance to other members.

EXPLANATION OF REFERENCE SIGNS

1 shaft cylinder
1A front shaft
1B back shaft
2 tip member
3 lead pipe
4 mechanical unit
5 lead rotating mechanism
6 slider
7 distal tip
8 receiving member
8*a* large-diameter annular wall
8*b* engagement projection
9 spacer
9*a* inner annular projection
9*b* anti-rotation projection
10 inner shaft
10A first cylindrical portion
10B second cylindrical portion
10C third cylindrical portion
10D fourth cylindrical portion
10*a* front inner stepped surface
10*b* intermediate inner stepped surface
10-1 front slit
10-2 intermediate slit
10-3 back slit
10-4 back end open slit
11 stopper
11*a* inner annular projection
11*b* anti-rotation projection
12 cushion spring
13 inner cylinder
13A small-diameter cylinder portion
13B large-diameter cylinder portion
14 return spring
15 engagement hole
16 wide opening
17 slit
18 back end cutout
19 cutout piece
19*a* taper surface
20 anti-rotation projection
21 clip
22 eraser
23 eraser holder
24 eraser cover
40 lead chuck
41 chuck ring
42 chuck joint
42A small-diameter cylindrical portion

42B intermediate cylindrical portion
42C large-diameter cylindrical portion
42D resilient piece
43 sleeve
43*a* inward flange
43*b* window hole
44 chuck spring
45 chuck body
50 tip cam face
51 inner cam face
52 inner cam face
53 outer cam face

The invention claimed is:

1. A mechanical pencil comprising a shaft cylinder, a lead pipe axially movably inserted into the shaft cylinder and biased in a retract direction, and a chuck body provided within the shaft cylinder in front of the lead pipe for gripping and releasing a writing lead, characterized in that:

the lead pipe and the chuck body are separated, the lead pipe is axially movably inserted into the shaft cylinder, and the chuck body is positioned within the shaft cylinder in front of the lead pipe to be movable in an axial direction and rotatable about an axis, wherein a lead rotating mechanism is provided between a back part of the chuck body and a front part of the lead pipe, and wherein when the lead pipe is advanced by a knocking operation or retracted by the release of the knocking operation, when writing pressure is applied to the writing lead, and when the writing pressure is released, the lead rotating mechanism only rotates the chuck body, but does not transmit a rotational force to the lead pipe.

2. The mechanical pencil as recited in claim 1, characterized in that the lead rotating mechanism is positioned so as to be movable in the axial direction and circumferentially rotatable together with a receiving member which is attached under bias in a retract direction with axial movement thereof being permitted and circumferential rotation thereof being restricted, and with a chuck joint which is integrally anchored to a back part of a lead chuck of the chuck body, the lead rotating mechanism being configured to only rotate the chuck body via the chuck joint when the lead pipe is advanced by the knocking operation or retracted by the release of the knocking operation, when the writing pressure is applied to the writing lead, and when the writing pressure is released.

3. The mechanical pencil as recited in claim 2, characterized in that the back end of the chuck joint has resilient pieces integrally provided at a back part thereof.

4. The mechanical pencil as recited in claim 2, characterized in that the lead rotating mechanism comprises an inner cylinder that is axially movably inserted into the shaft cylinder and biased in the retract direction with its rotation about the axis controlled, wherein the lead rotating mechanism has an inner cam face on the non-rotating side which is formed inside of the inner cylinder, and an outer cam face on the rotating side which is formed outside of the chuck joint to be opposed to the inner cam face of the inner cylinder, and wherein when the chuck body is advanced by releasing the writing pressure of the writing lead, and when the lead pipe and the inner cylinder are retracted by the release of the knocking operation, the lead rotating mechanism is configured to rotate the chuck body while the outer cam face of the chuck joint mates with the inner cam face of the inner cylinder.

5. The mechanical pencil as recited in claim 4, characterized in that the back end of the chuck joint has resilient pieces integrally provided at a back part thereof.

6. The mechanical pencil as recited in claim 4, characterized in that the outer cam face of the chuck joint and the inner cam face of the inner cylinder are configured such that when the writing pressure is applied to the writing lead, and upon the knocking operation, the chuck joint rotates to a position where apexes of the cam faces are circumferentially position-shifted so as to separately hold the outer cam face of the chuck joint and the inner cam face of the inner cylinder.

7. The mechanical pencil as recited in claim 6, characterized in that the back end of the chuck joint has resilient pieces integrally provided at a back part thereof.

8. The mechanical pencil as recited in claim 2, characterized in that the lead rotating mechanism comprises a tip cam face on a non-rotating side which is formed at a tip of the receiving member, and an inner cam face on a rotating side which is formed on an inner face of a back part of the chuck joint and opposite to the tip cam face of the receiving member, and that when the chuck body is retracted by the writing pressure of the writing lead, and when the lead pipe and receiving member are integrally advanced by the knocking operation, the lead rotating mechanism is configured to rotate the chuck body while the tip cam face of the receiving member mates with the inner cam face of the chuck joint.

9. The mechanical pencil as recited in claim 8, characterized in that the back end of the chuck joint has resilient pieces integrally provided at a back part thereof

10. The mechanical pencil as recited in claim 8, characterized in that while in a normal condition in which the chuck body grips the writing lead without the writing pressure applied, and while no knocking operation is performed, respective apexes of the inner cam face of the chuck joint and the tip cam face of the receiving member are circumferentially position-shifted.

11. The mechanical pencil as recited in claim 10, characterized in that the back end of the chuck joint has resilient pieces integrally provided at a back part thereof.

12. The mechanical pencil as recited in claim 8, characterized in that the lead rotating mechanism comprises an inner cylinder that is axially movably inserted into the shaft cylinder and biased in the retract direction with its rotation about the axis controlled, wherein the lead rotating mechanism has an inner cam face on the non-rotating side which is formed inside of the inner cylinder, and an outer cam face on the rotating side which is formed outside of the chuck joint to be opposed to the inner cam face of the inner cylinder, and wherein when the chuck body is advanced by releasing the writing pressure of the writing lead, and when the lead pipe and the inner cylinder are retracted by the release of the knocking operation, the lead rotating mechanism is configured to rotate the chuck body while the outer cam face of the chuck joint mates with the inner cam face of the inner cylinder.

13. The mechanical pencil as recited in claim 12, characterized in that the back end of the chuck joint has resilient pieces integrally provided at a back part thereof.

14. The mechanical pencil as recited in claim 12, characterized in that the outer cam face of the chuck joint and the inner cam face of the inner cylinder are configured such that when the writing pressure is applied to the writing lead, and upon the knocking operation, the chuck joint rotates to a position where apexes of the cam faces are circumferentially position-shifted so as to separately hold the outer cam face of the chuck joint and the inner cam face of the inner cylinder.

15. The mechanical pencil as recited in claim 14, characterized in that the back end of the chuck joint has resilient pieces integrally provided at a back part thereof.

* * * * *